US006447662B1

(12) United States Patent
Brouwer et al.

(10) Patent No.: US 6,447,662 B1
(45) Date of Patent: Sep. 10, 2002

(54) PROCESS FOR PHOSPHATIZING, RERINSING AND CATHODIC ELECTRO-DIPCOATING

(75) Inventors: Jan-Willem Brouwer, Willich (DE); Bernd Schenzle, Troy, MO (US); Peter Kuhm, Hilden (DE); Winfried Wichelhaus, Wuelfrath (DE); Helmut Endres, Langenfeld (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/744,759

(22) PCT Filed: Jul. 23, 1999

(86) PCT No.: PCT/EP99/05273

§ 371 (c)(1),
(2), (4) Date: Apr. 6, 2001

(87) PCT Pub. No.: WO00/08231

PCT Pub. Date: Feb. 17, 2000

(30) Foreign Application Priority Data

Aug. 1, 1998 (DE) ..... 198 34 796

(51) Int. Cl.[7] ..... C25D 13/12

(52) U.S. Cl. ..... 204/486; 204/495; 204/499; 204/504; 204/506; 148/260; 148/262

(58) Field of Search ..... 204/486, 495, 204/499, 504, 506; 148/260, 262

(56) References Cited

U.S. PATENT DOCUMENTS

| | | | | |
|---|---|---|---|---|
| 5,207,840 A | | 5/1993 | Riesop et al. | 148/260 |
| 5,702,581 A | * | 12/1997 | Kerlin et al. | 204/486 |
| 5,792,283 A | | 8/1998 | Roland et al. | 148/260 |
| 6,090,224 A | | 7/2000 | Wichelhaus et la. | 148/256 |

FOREIGN PATENT DOCUMENTS

| | | |
|---|---|---|
| DE | 2100497 | 9/1971 |
| DE | 2403022 | 8/1974 |
| DE | 2428065 | 1/1975 |
| DE | 3400339 | 8/1985 |
| DE | 3920296 | 1/1991 |
| DE | 4330104 | 3/1995 |
| DE | 4341041 | 6/1995 |
| DE | 19511573 | 10/1996 |
| DE | 19634685 | 3/1998 |
| DE | 19705701 | 8/1998 |
| DE | 19733978 | 2/1999 |
| EP | 0060716 | 9/1982 |
| EP | 0106459 | 4/1984 |
| EP | 0228151 | 7/1987 |
| EP | 0315059 | 5/1989 |
| EP | 0321059 | 6/1989 |
| EP | 0410497 | 6/1990 |
| EP | 0492713 | 7/1992 |
| NL | 7116498 | 6/1972 |
| SU | 1740028 | 2/1988 |
| WO | 9200087 | 9/1992 |
| WO | 9503648 | 4/1996 |

* cited by examiner

*Primary Examiner*—Kishor Mayekar
(74) *Attorney, Agent, or Firm*—Stephen D. Harper; David S. Abrams

(57) ABSTRACT

A process for pretreating surfaces made from steel, galvanised steel and/or aluminum and/or alloys thereof, wherein, in a first process stage, phosphating is performed using a low-nickel zinc phosphating solution; in a second process stage, the phosphated surfaces are post-rinsed using an aqueous solution which contains 0.001 to 10 g/l of lithium ions; copper ions and/or silver ions; and, in a third process stage, a low-lead cathodically depositable electrocoating lacquer is applied which contains no more than 0.05 wt. % of lead, relative to the dry solids content of the lacquer.

11 Claims, No Drawings

PROCESS FOR PHOSPHATIZING, RERINSING AND CATHODIC ELECTRO-DIPCOATING

This application is a 35 U.S.C. 371 National Stage filing of PCT/EP 99/05,273 filed Jul. 23, 1999.

FIELD OF THE INVENTION

This invention relates to a section from a processing sequence, as is conventional for coating metal surfaces, in particular in automotive construction: phosphating, followed by post-rinsing and cathodic electrocoating. The present invention solves the problem that, on a phosphate layer produced using a low-nickel phosphating solution, low-lead or lead-free cathodic electrocoating lacquers frequently exhibit substantially poorer corrosion protection and lacquer adhesion properties than either cathodically depositable electrocoating lacquers containing lead or alternatively lead-free cathodically depositable electrocoating lacquers on a phosphate layer which was produced using a high-nickel phosphating solution. The process may be used to treat surfaces made from steel, galvanised or alloy-galvanised steel, aluminum, aluminised or alloy-aluminised steel.

BACKGROUND OF THE INVENTION

An object of phosphating metals is to produce on the metal surface strongly adhering metal phosphate layers which in themselves improve corrosion resistance and, in conjunction with lacquers and other organic coatings, contribute towards a substantial increase in lacquer adhesion and resistance to creepage on exposure to corrosion. Such phosphating processes have long been known. Low-zinc phosphating processes, in which the phosphating solutions have relatively low contents of zinc ions of, for example, 0.3 to 3 g/l and in particular of 0.5 to 2 g/l, are in particular suitable for pretreatment prior to lacquer coating.

RELATED ART

It has been found that phosphate layers having distinctly improved corrosion protection and lacquer adhesion properties may be formed by also using other polyvalent cations in the zinc-phosphating baths. For example, low-zinc processes with the addition of, for example, 0.5 to 1.5 g/l of manganese ions and, for example, 0.3 to 2.0 g/l of nickel ions are widely used in the so-called trication process for preparing metal surfaces for lacquer coating, for example for cathodic electrocoating of automotive bodywork. Reference is made by way of example to EP-B-106 459 and EP-B-228 151.

The elevated content of nickel ions in the phosphating solutions of the trication process and of nickel and nickel compounds in the resultant phosphate layers is, however, disadvantageous in that nickel and nickel compounds are classed as critical with regard to environmental protection and occupational hygiene. Accordingly, increasing numbers of low-zinc phosphating processes have recently been described which, without using nickel, give rise to phosphate layers of a similarly high quality to those obtained using the processes involving nickel.

DE-A-39 20 296, for example, describes a phosphating process which dispenses with nickel and uses magnesium ions in addition to zinc and manganese ions. The phosphating baths described herein contain, in addition to 0.2 to 10 g/l of nitrate ions, further oxidising agents which act as accelerators, selected from nitrite, chlorate or an organic oxidising agent. EP-A-60 716 discloses low-zinc phosphating baths which contain zinc and manganese as essential cations and which may contain nickel as an optional constituent. The necessary accelerator is preferably selected from nitrite, m-nitrobenzenesulfonate or hydrogen peroxide. EP-A-228 151 also describes phosphating baths which contain zinc and manganese as the essential cations. The phosphating accelerator is selected from nitrite, nitrate, hydrogen peroxide, m-nitrobenzoate or p-nitrophenol.

DE-A-43 41 041 describes a process for phosphating metal surfaces using aqueous, acidic phosphating solutions which contain zinc, manganese and phosphate ions and, as accelerator, m-nitrobenzenesulfonic acid or water-soluble salts thereof, wherein the metal surfaces are contacted with a phosphating solution which contains no nickel, cobalt, copper, nitrite or halogen oxo-anions and which contains:

0.3 to 2 g/l of Zn(II)

0.3 to 4 g/l of Mn(II)

5 to 40 g/l of phosphate ions 0.2 to 2 g/l of min-nitrobenzenesulfonate and 0.2 to 2 g/l of nitrate ions.

A similar process is described in DE-A-43 30 104, wherein 0.1 to 5 g of hydroxylamine are used as the accelerator instead of the nitrobenzenesulfonate.

Depending upon the composition of the solution used for phosphating, the accelerator used for the phosphating process, the process for applying the phosphating solution onto the metal surfaces and/or also other processing parameters, the phosphate layer on the metal surfaces is not completely sealed. Instead, "pores" of a greater or lesser size amounting to an area of 0.5 to 2% of the phosphated surface remain which must be sealed in a so-called post-rinsing ["post-passivation"] operation in order to leave no point of attack open to corroding influences on the metal surfaces. Post-passivation moreover improves the adhesion of a subsequently applied lacquer.

It has long been known to use solutions containing chromium salts for this purpose. In particular, post-treatment of the surfaces using solutions containing chromium(VI) substantially improves the corrosion resistance of the coatings produced by phosphating. The improvement in corrosion protection is primarily due to the fact that a proportion of the phosphate deposited on the metal surface is converted in a metal(II)/chromium spinel.

A substantial disadvantage of using solutions containing chromium salts is that such solutions are highly toxic. Furthermore, an increased incidence of unwanted blistering is observed when lacquers or other coating materials are subsequently applied.

Many other possibilities for post-passivation of phosphated metal surfaces have accordingly been proposed, such as using zirconium salts (NL patent 71 16 498), cerium salts (EP-A-492 713), polymeric aluminum salts (WO 92/15724), oligo- or poly-phosphoric acid esters of inositol in conjunction with a water-soluble alkali metal or alkaline earth metal salt of these esters (DE-A-24 03 022) or also fluorides of various metals (DE-A-24 28 065).

EP-B-410 497 discloses a post-rinsing solution which contains Al, Zr and fluoride ions, wherein the solution may be regarded either as a mixture of complex fluorides or also as a solution of aluminum hexafluorozirconate. The total quantity of these three ions is in the range from 0.1 to 2.0 g/l.

DE-A-21 00 497 relates to a process for the electrophoretic application of paints onto surfaces containing iron, wherein the object to be achieved is that of applying white or other light colored paints onto surfaces containing iron without discoloration. This object is achieved by rinsing the surfaces, which may previously have been phosphated, using solutions containing copper. Copper concentrations of between 0.1 and 10 g/l are proposed for this post-rinsing solution. DE-A-34 00 339 also describes a post-rinsing solution containing copper for phosphated metal surfaces, wherein copper contents of between 0.01 and 10 g/l are used.

Of the processes mentioned above for post-rinsing phosphate layers, the only ones to have met with success (other than post-rinsing solutions containing chromium) are those in which solutions of complex fluorides of titanium and/or zirconium are used. Organic reactive post-rinsing solutions based on amine-substituted polyvinylphenols are additionally used. In conjunction with a phosphating process involving nickel, these chromium-free post-rinsing solutions fulfill the stringent lacquer adhesion and corrosion protection requirements of, for example, the automotive industry. However, for reasons of environmental protection and occupational hygiene, efforts are being made to introduce phosphating processes in which the use of both nickel and chromium compounds may be dispensed with at all stages of treatment. Nickel-free phosphating processes in conjunction with a chromium-free post-rinsing do not as yet reliably fulfill lacquer adhesion and corrosion protection requirements on all bodywork materials used in the automotive industry. This is particularly the case if, after phosphating and post-rinsing, a cathodically depositable electrocoating lacquer, which for reasons of occupational hygiene and environmental protection contains no compounds containing lead, is applied onto the metal surface.

DE-A-195 11 573 describes a phosphating process using a phosphating solution which contains neither nitrite nor nickel and in which, after phosphating, post-rinsing is performed using an aqueous solution having a pH in the range of 3 to 7 which contains 0.001 to 10 g/l of one or more of the following cations: lithium ions, copper ions and/or silver ions. German Patent Application DE 197 05 701.2 extends this to low-nickel phosphating solutions. These documents contain no indication that it is possible by means of the post-rinsing to offset the disadvantages arising from lead-free cathodic electrocoating after nickel-free phosphating.

Efforts are currently being made to replace conventional cathodically depositable electrocoating lacquers, which contain lead compounds as catalysts to accelerate the crosslinking reaction, with low-lead or lead-free cathodic electrocoating lacquers. These give rise to adequate corrosion protection if phosphating is performed using a phosphating solution which contains either more than 100 ppm of nickel ions or more than 1 ppm of copper ions. If, however, for reasons of environmental protection and occupational hygiene, phosphating solutions containing less than 100 ppm of nickel ions or less than 1 ppm of copper ions are used, low-lead or lead-free cathodically depositable electrocoating lacquers exhibit unsatisfactory corrosion protection properties at least if post-rinsing using a solution containing chromium is dispensed with after phosphating.

SUMMARY OF THE INVENTION

Thus, there is a requirement for a processing sequence comprising phosphating/post-rinsing/cathodic electrocoating, in which it is possible entirely to dispense with the use of chromium compounds and in which it is possible to use treatment baths which should have the lowest possible nickel and lead contents, if possible entirely dispensing with the use of these metals. In so-doing, corrosion protection properties should, however, be achieved which are not inferior to those which may be achieved by using high-nickel phosphating solution and/or a cathodic electrocoating lacquer containing lead.

This object is achieved by a process for pretreating surfaces made from steel, galvanized steel and/or aluminum and/or from alloys, which consist to an extent of at least 50 wt. % of iron, zinc or aluminum, comprising the process stages:

(a) layer-forming phosphating;

(b) post-rinsing;

(c) cathodic electrocoating;

characterised in that:

in process stage (a), phosphating is performed using an acidic phosphating solution containing zinc which has a pH in the range from 2.5 to 3.6 and which contains:
- 0.3 to 3 g/l of Zn(II),
- 5 to 40 g/l of phosphate ions, at least one of the following accelerators:
- 0.2 to 2 g/l of m-nitrobenzenesulfonate ions,
- 0.1 to 10 g/l of hydroxylamine in free or bound form,
- 0.05 to 2 g/l of m-nitrobenzoate ions,
- 0.05 to 2 g/l of p-nitrophenol,
- 1 to 70 mg/l of hydrogen peroxide in free or bound form,
- 0.01 to 0.2 g/l of nitrite ions
- 0.05 to 4 g/l of organic N-oxides
- 0.1 to 3 g/l of nitroguanidine and no more than 50 mg/l of nickel ions;

in process stage (b), post-rinsing is performed using an aqueous solution having a pH in the range from 3 to 7, which contains 0.001 to 10 g/l of one or more of the following cations: lithium ions, copper ions and/or silver ions;and in process stage (c), lacquer coating is performed using a cathodically depositable electrocoating lacquer which contains no more than 0.05 wt. % of lead, relative to the dry solids content of the electrocoating lacquer.

DETAILED DESCRIPTION OF THE INVENTION

Instead of relating the maximum lead content to the dry solids content of the cathodically depositable electrocoating lacquers, it is possible to state the upper limit of the lead content in the ready-to-use aqueous bath of the cathodically depositable electrocoating lacquer. The lead content of the lacquer bath should accordingly be no more than about 150 mg of lead per liter of bath liquid. In particular, the lead content should be no more than about 0.01 wt. %, relative to the dry solids content of the electrocoating lacquer. Cathodically depositable electrocoating lacquers used for the purposes of the present invention are preferably those to which no lead compounds have been added.

The term "layer-forming phosphating" in process stage (a) is generally known in the relevant technical area. It means that a crystalline metal phosphate layer, into which divalent metal ions from the phosphating solution are incorporated, is deposited onto the substrate. When performing layer-forming phosphating on surfaces containing iron or zinc, metal ions from the surface metal are also incorporated into the phosphate layer. A distinction is to be drawn between this process and so-called "non layer-forming phosphating". In this latter process, the metal surface is treated using a phosphating solution containing no divalent metal ions which are incorporated into the resultant thin, generally non-crystalline, phosphate and oxide layer.

The phosphating solution used in process stage (a) preferably contains no copper ions. Under practical operating conditions, however, it is impossible to ensure that such ions are not introduced into the phosphating bath by chance. Preferably, however, no copper ions are deliberately added to the phosphating bath, such that it may be expected that the phosphating solution will contain no more than about 1 mg/l of copper ions.

According to the present invention, a phosphating solution is used in process stage (a) which contains no more than 50 mg/l of nickel ions. It is, however, possible completely to dispense with addition of nickel ions to the phosphating solution. This is preferred for reasons of occupational hygiene and environmental protection. However, since the containers for the phosphating solutions generally consist of stainless steel which contains nickel, it is impossible to ensure that nickel ions do not pass from the surface of the container into the phosphating bath. The resultant nickel contents in the phosphating solution are generally below 10 mg/l. It is accordingly preferred in the processing sequence according to the present invention to use a phosphating solution having the lowest possible nickel content, preferably a nickel-free phosphating solution, which should at least, however, contain no more than about 10 mg/l of nickel ions. The nickel content is preferably below 1 mg/l.

The phosphating solution used in process stage (a) of the processing sequence according to the present invention preferably contains one or more further metal ions known from the prior art to have a positive action on the corrosion protection of zinc phosphate layers. In this connection, the phosphating solution may contain one or more of the following cations:

0.2 to 4 g/l of manganese(II)

0.2 to 2.5 gel of magnesium(II), 0.2 to 2.5 g/l of calcium(II), 0.01 to 0.5 g/l of iron(II), 0.2 to 1.5 g/l of lithium(l), 0.02 to 0.8 g/l of tungsten(VI).

The presence of manganese and/or lithium is particularly preferred in this connection. The possible presence of divalent iron is dependent upon the accelerator system described below. The presence of iron(II) in the stated concentration range presupposes an accelerator which has no oxidising action towards these ions. Hydroxylamine is one example of such an accelerator which may be mentioned.

In a similar manner as described in EP-A-321 059, the presence in the processing sequence according to the present invention of soluble compounds of hexavalent tungsten in the phosphating bath is also advantageous with regard to corrosion resistance and lacquer adhesion. Phosphating solutions may be used in the phosphating process according to the present invention which contain 20 to 800 mg/l, preferably 50 to 600 mg/l of tungsten in the form of water-soluble tungstates, silicotungstates and/or borotungstates. The stated anions may here be used in the form of acids thereof and/or water-soluble salts thereof, preferably ammonium salts.

In phosphating baths which are intended to be suitable for different substrates, it has become conventional to add free and/or complexed fluoride in quantities of up to 2.5 g/l total fluoride, up to 800 mg/l of which as free fluoride. The presence of such quantities of fluoride is also advantageous for the phosphating baths in the context of the present invention. In the absence of fluoride, the aluminum content of the bath should not exceed 3 mg/l. In the presence of fluoride, thanks to complexation, higher Al contents may be tolerated, provided that the concentration of non-complexed Al does not exceed 3 mg/l. Thus, it is advantageous to use baths containing fluoride if the surfaces to be phosphated consist at least in part of aluminum or contain aluminum. In these cases, it is advantageous to use not complexed, but instead only free fluoride, preferably in concentrations in the range from 0.5 to 1.0 g/l.

When phosphating zinc surfaces, it is not absolutely essential for the phosphating baths to contain so-called accelerators. It is, however, necessary when phosphating steel surfaces for the phosphating solution to contain one or more accelerators. Such accelerators are conventional components of zinc phosphating baths. These are taken to be substances which chemically bind the hydrogen produced by the pickling attack of the acid on the metal surface by themselves being reduced. Oxidising accelerators also have the effect of oxidising iron(II) ions liberated by the pickling attack on steel surfaces to the trivalent state, so that they may precipitate as iron(III) phosphate. The accelerators usable in the phosphating bath of the processing sequence according to the present invention have been listed above.

Nitrate ions in quantities of up to 10 g/l may additionally be present as co-accelerators, which may have favourable effects, in particular when phosphating steel surfaces. However, when phosphating galvanised steel, it is preferable for the phosphating solution to contain the least possible nitrate. Nitrate concentrations should preferably not exceed 0.5 g/l, as there is a risk of so-called "speckling" at higher nitrate concentrations. Speckling comprises white, crater-like defects in the phosphate layer which impair 0 corrosion protection.

Hydrogen peroxide is particularly preferred as an accelerator for reasons of environmental protection, while hydroxylamine is particularly preferred as an accelerator for technical reasons as it simplifies the formulation of replenishing solutions. It is, however, not advisable to use these two accelerators together as hydroxylamine is decomposed by hydrogen peroxide. If hydrogen peroxide is used as the accelerator in free or bound form, concentrations of 0.005 to 0.02 g/l of hydrogen peroxide are particularly preferred. It is possible to add the hydrogen peroxide as such to the phosphating solution. It is, however, also possible to use hydrogen peroxide in bound form in the form of compounds which liberate hydrogen peroxide in the phosphating bath by hydrolysis reactions. Examples of such compounds are per salts, such as perborates, percarbonates, peroxysulfates or peroxydisulfates. Further sources of hydrogen peroxide which may be considered are ionic peroxides, such as alkali metal peroxides.

Hydroxylamine may be used as the free base, as a hydroxylamine complex or in the form of hydroxylammonium salts. If free hydroxylamine is added to the phosphating bath or to a phosphating bath concentrate, it will be present in these solutions largely as the hydroxylammonium cation due to the acidic nature of these solutions. When it is used as a hydroxylainmonium salt, the sulfates and phosphates are particularly suitable. In the case of the phosphates, the acidic salts are preferred due to the better solubility thereof. Hydroxylainine or compounds thereof are added to the phosphating bath in quantities such that the calculated concentration of the free hydroxylamine is between 0.1 and 10 g/l, preferably between 0.2 and 6 g/l and in particular between 0.3 and 2 g/l. It is known from EP-B-315 059 that using hydroxylamine as the accelerator on iron surfaces results in particularly favourable spherical and/or columnar phosphate crystals. The post-rinsing to be performed in process stage (b) is particularly suitable as a post-passivation of such phosphate layers.

The action of hydroxylamine as an accelerator may be promoted by additionally using chlorate. This accelerator combination, which may also be used for the purposes of the present invention, is described in German patent application DE-A-197 16 075.1.

Organic N-oxides, as are described in greater detail in German Patent Application DE-A-197 33 978.6, may also be considered as accelerators. N-methylmorpholine N-oxide is particularly preferred as an organic N-oxide. The N-oxides are preferably used in combination with co-accelerators, such as chlorate, hydrogen peroxide, m-nitrobenzenesulfonate or nitroguanidine. Nitroguanidine may also be used as the sole accelerator, as is described, for example, in DE-A-196 34 685.

If phosphating baths containing lithium are selected, the preferred concentrations of lithium ions are in the range from 0.4 to 1 g/l. Particularly preferred phosphating baths in this case are those which contain lithium as the sole monovalent cation. Depending upon the desired ratio of phosphate ions to the divalent cations and the lithium ions, it may, however, be necessary to add further basic substances to the phosphating baths to adjust the desired free acid. In this case, ammonia is preferably used, such that phosphating baths containing lithium may additionally contain ammonium ions in a range from about 0.5 to about 2 g/l. It is less preferred in this case to use basic sodium compounds, such as sodium hydroxide solution, as the presence of sodium ions in the phosphating baths containing lithium impairs the corrosion protection characteristics of the resultant layers. In the case of lithium-free phosphating baths, free acid is preferably adjusted by adding basic sodium compounds, such as sodium carbonate or sodium hydroxide.

Particularly good corrosion protection results are achieved using phosphating baths which contain manganese (II) in addition to zinc and optionally lithium. The manganese content of the phosphating bath should be between 0.2 and 4 g/l, as the positive influence on corrosion behavior is not obtained at lower manganese contents and no further positive effect is achieved at higher manganese contents. Contents of between 0.3 and 2 g/l and in particular between 0.5 and 1.5 g/l are preferred. The zinc content of the phosphating bath is preferably adjusted to between 0.45 and 2 g/l. However, as a result of surface removal by pickling when surfaces containing zinc are phosphated, it is possible for the actual zinc content of the operating bath to rise to up to 3 g/l. The form in which the zinc and manganese ions are introduced into the phosphating baths is in principle immaterial. It is in particular convenient to use oxides and/or carbonates as the source of zinc and/or manganese.

When the phosphating process is used on steel surfaces, iron passes into solution in the form of iron(II) ions. In the event that the phosphating baths contain no substances which have a strongly oxidising action towards iron(II), the divalent iron is converted, primarily as a result of atmospheric oxidation, into the trivalent state, such that it may precipitate as iron(III) phosphate. Iron(II) contents may thus build in the phosphating baths which are distinctly above the contents of baths containing an oxidising agent. This is the case, for example, in phosphating baths containing hydroxylamine. In this connection, iron(II) concentrations of up to 50 ppm are normal, wherein values of up to 500 ppm may occur briefly during the course of production. Such iron(II) concentrations are not detrimental to the phosphating process according to the present invention.

The weight ratio of phosphate ions to zinc ions in the phosphating baths may vary within broad limits, providing that it is within the range between 3.7 and 30. A weight ratio of between 7 and 25 is particularly preferred. For the purposes of this calculation, the entire phosphorus content of the phosphating bath is assumed to be present in the form of phosphate ions $PO_4^{3-}$. Accordingly, calculation of the weight ratio ignores the known fact that, at the pH's prevailing in phosphating baths, which are conventionally within the range from about 3 to about 3.4, only a very small proportion of the phosphate is actually present in the form of the anions bearing three negative charges. It may instead be expected at these pH's that the phosphate is primarily present as a dihydrogen phosphate anion bearing a single negative charge, together with smaller quantities of undissociated phosphoric acid and of hydrogen phosphate anions bearing two negative charges.

Further parameters known to the person skilled in the art for controlling phosphating baths are the free acid and total acid contents. The method for determining these parameters for the present purposes is indicated in the Examples. Free acid values of between 0 and 1.5 points and total acid values of between about 15 and about 35 points are within the industrially conventional range and are suitable for the purposes of the present invention.

Phosphating may be performed by spraying, dipping or spray-dipping. Contact times are here within the conventional range of between about 1 and about 4 minutes. The temperature of the phosphating solution is within the range between about 40 and about 60° C. The conventional prior art stages of cleaning and activation, preferably using activating baths containing titanium phosphate, should be performed before phosphating.

An intermediate rinsing using water may proceed between the phosphating according to process stage (a) and the post-rinsing according to process stage (b). This is not, however, necessary and it may even be advantageous to dispense with this intermediate rinsing, as in this case the post-rinsing solution may react with the phosphating solution still adhering to the phosphated surface, which has a favourable effect on corrosion protection.

The post-rinsing solution used in process stage (b) preferably has a pH in the range from 3.4 to 6 and a temperature in the range from 20 to 50° C. The concentrations of cations in the aqueous solution used in process stage (b) are preferably within the following ranges: lithium(l) 0.02 to 2, in particular 0.2 to 1.5 g/l, copper(II) 0.002 to 1 g/l, in particular 0.01 to 0.1 g/l and silver(I) 0.002 to 1 g/l, in particular 0.01 to 0.1 g/l. The stated metal ions may here be present individually or as a mixture with each other. Post-rinsing solutions containing copper(II) are particularly preferred.

The form in which the stated metal ions are introduced into the post-rinsing solution is in principle immaterial, provided that it is ensured that the metal compounds are soluble within the stated concentration ranges of the metal ions. However, metal compounds having anions known to promote a tendency towards corrosion, such as chloride, should be avoided. It is particularly preferred to use the metal ions as nitrates or as carboxylates, in particular as acetates. Phosphates are also suitable, provided that they are soluble under the stated concentration and pH conditions. The same applies to sulfates.

In one particular embodiment, the metal ions of lithium, copper and/or silver are used in the post-rinsing solutions, together with 0.1 to 1 g/l of hexafluorotitanate ions and/or, particularly preferably, hexafluorozirconate ions. It is preferred here that the concentrations of the stated anions are within the range from 100 to 500 ppm. Sources of the stated hexafluoro anions which may be considered are acids thereof or salts thereof which are soluble in water under the stated concentration and pH conditions, in particular the alkali metal and/or ammonium salts thereof. It is particularly favourable to use the hexafluoro anions at least in part in the form of acids thereof and to dissolve basic compounds of lithium, copper and/or silver in the acidic solutions. Compounds which may be considered for this purpose are, for example, the hydroxides, oxides or carbonates of the stated metals. This approach ensures that the metals are not used together with possibly disruptive anions. The pH may, if necessary, be adjusted using ammonia or sodium carbonate.

The post-rinsing solutions may additionally contain the ions of lithium, copper and/or silver, together with ions of cerium(III) and/or cerium(IV), wherein the total concentration of cerium ions is in the range from 0.01 to 1 g/l.

Apart from the ions of lithium, copper and/or silver, the post-rinsing solution may also contain aluminum(III) compounds, wherein the concentration of aluminum is in the range from 0.01 to 1 g/l. Aluminum compounds which may in particular be considered are, on the one hand, polyaluminum compounds, such as polymeric aluminum hydroxychloride or polymeric aluminum hydroxysulfate (WO 92/15724), or alternatively complex aluminum/zirconium fluorides, as are known, for example, from EP-B-410 497.

The metal surfaces phosphated in process stage (a) may be contacted with the post-rinsing solution in process stage (b) by spraying, dipping or spray-dipping, wherein the contact time should be in the range from 0.5 to 10 minutes and is preferably about 40 to about 120 seconds. Due to the simpler processing plant, it is preferable to spray the post-rinsing solution in process stage (b) onto the metal surface phosphated in process stage (a).

It is not, in principle, necessary to rinse off the treatment solution on completion of the contact period and before subsequent cathodic electrocoating. In order to prevent contamination of the lacquer bath, it is preferable to rinse the post-rinsing solution off the metal surfaces after the post-rinsing according to process stage (b), preferably using low-salt or deionised water. Before introduction into the electrocoating tanks, the metal surfaces pretreated according to the present invention may be dried. Such drying is, however, preferably omitted in the interest of a shorter production cycle.

Cathodic electrocoating is then performed in process stage (c) using a cathodically depositable electrocoating lacquer, which is at least low in lead, but preferably lead-free. "Low in lead" is here to be taken to mean that the cathodically depositable electrocoating lacquer contains no more than 0.05 wt. % of lead, relative to the dry solids content of the electrocoating lacquer. The lacquer preferably contains less than 0.01 wt. % of lead, relative to the dry solids content, and preferably no deliberately-added lead compounds. Examples of such electrocoating lacquers are commercially available. Examples which may be mentioned are: Cathoguard® 310and Cathoguard® 400 from BASF, Aqua EC 3000 from Herberts and Enviroprime® from PPG.

EXAMPLES

The processing sequence according to the present invention was tested on sheet steel, as used in automotive construction. To this end, the following dipping procedure, as is conventional in vehicle body production, was performed:

1. Cleaning using an alkaline cleaner (Ridoline® 1559, Henkel KGaA), 2% preparation in plant water, 55° C., 4 minutes.
2. Rinsing using plant water, room temperature, 1 minute.
3. Activation by dipping into an activating agent containing titanium phosphate (Fixodine® C 9112, Henkel KGaA), 0.1% preparation in completely deionised water, room temperature, 1 minute.
4. Process stage (a): phosphating using a phosphating bath of the following composition (prepared in completely deionised water):

| | |
|---|---|
| $Zn^{2+}$ | 1.3 g/l |
| $Mn^{2+}$ | 0.8 g/l |
| $H_2PO_4^-$ | 13.8 g/l |
| $SiF_6^{2-}$ | 0.7 g/l |
| Hydroxylamine | 1.1 g/l (used as free amine) |
| Free acid | 1.1 points |
| Total acid | 24 points |

A part from the stated cations, the phosphating bath optionally contained sodium or ammonium ions to adjust free acid. Temperature: 50° C., time: 4 minutes.

The free acid point value is taken to be the number of ml of 0.1 N sodium hydroxide consumed in order to titrate 10 ml of bath solution to a pH of 3.6. Similarly, the total acid point value indicates the number of ml consumed to give a pH of 8.2.

5. Rinsing using plant water, room temperature, 1 minute.
6. Process stage (b): post-rinsing using a solution according to Table 1, 40° C., 1 minute.
7. Rinsing using completely deionised water.
8. Drying using compressed air.
9. Process stage (c): coating using a cathodic electrocoating lacquer: comparison containing Pb: FT 85-7042 (BASF); according to the present invention: lead-free: Cathoguard 310 (BASF).

In the post-rinsing solutions according to Table 1, Cu was used as the acetate, $ZrF_6^{2-}$as the free acid. pH's were corrected upwards using sodium carbonate.

Corrosion protection testing was performed in accordance with VDA alternating climatic conditions test 621–415. The result is stated in Table 2 as creepage at the scratch (U/2: half scratch width, in mm). Lacquer adhesion was also tested in accordance with the VW stone impact test, which results in a K value. Higher K values mean poorer lacquer adhesion, lower K values better lacquer adhesion. The results are also shown in Table 2.

TABLE 1

Post-rinsing solutions (in completely deionised water)

| | Solution 1 (according to the present invention) | Solution 2 (comparison) |
|---|---|---|
| Zr (as $ZrF_6^{2-}$) | 100 ppm | 100 ppm |
| Cu | 50 ppm | — |
| pH | 4.1 | 4.1 |

TABLE 2

| | | Corrosion protection results | | | |
|---|---|---|---|---|---|
| | Process | Cathodic electrocoating lacquer containing Pb (FT 85-7042) | | Pb-free cathodic electrocoating lacquer (Cathoguard 310) | |
| No. | stage (b) | U/2 | K value | U/2 | K value |
| Comp. 1 | Solution 2 | 1.2 | 7–8 | | |
| Comp. 2 | Solution 2 | | | 1.9 | 9–10 |
| Comp. 3 | Solution 1 | 1.0 | 6–7 | | |
| Example 1 | Solution 1 | | | 1.0 | 6–7 |

Comparison 1 and comparison 2 (Table 2) show that the processing sequence: phosphating using a nickel-free phosphating solution, post-rinsing using an industrially used copper-free post-rinsing solution and subsequent cathodic electrocoating using a lead-free cathodically depositable electrocoating lacquer (comparison 2) yields substantially poorer corrosion protection results than when cathodic electrocoating is performed using a cathodically depositable electrocoating lacquer containing lead (comparison 1). Example 1 shows that substantially better corrosion protection values are obtained when the lead-free cathodic electrocoating lacquer is used after post-rinsing using a post-rinsing solution containing copper (solution 1). These values match those which are obtained using a cathodic electrocoating containing lead after post-rinsing using a post-rinsing solution containing copper (solution 1) (comparison 3). Thus, while a lead-free cathodic electrocoating lacquer after a nickel-free phosphating followed by copper-free post-rinsing exhibits distinct corrosion protection disadvantages in comparison with an electrocoating lacquer containing lead, these disadvantages disappear if post-rinsing is performed according to the present invention using a solution containing copper after phosphating. The process according to the present invention accordingly permits the individual stages to be combined without technical disadvantages, each of which stages is toxicologically and environmentally advantageous: low-nickel, preferably nickel-free phosphating and low-lead, preferably lead-free cathodic electrocoating.

What is claimed is:

1. A process for pretreating surfaces of at least one metal selected from the group consisting of steel, galvanized steel, aluminum and alloys of which at least 50% by weight consist of iron, zinc or aluminum, comprising the process stages:

(a) layer-forming phosphating, (b) post-rinsing, (c) cathodic electrocoating;

wherein:

in process stage (a), phosphating is performed with an acidic phosphating solution containing zinc which has a pH range in the range from 2.5 to 3.6 and which contains:

0.3 to 3 g/l of Zn(II) ions, 5 to 40 g/l of phosphate ions, at least one of the following accelerators:

0.2 to 2 g/l of m-nitrobenzenesulfonate ions, 0.1 to 10 g/l of hydroxylamine in free or bound form, 0.05 to 2 g/l of m-nitrobenzoate ions, 0.05 to 2 g/l of p-nitrophenol, 1 to 70 mg/l of hydrogen peroxide in free or bound form, 0.01 to 0.2 g/l of nitrite ions 0.05 to 4 g/l of organic N-oxides 0.1 to 3 g/l of nitroguanidine and no more than 50 mg/l of nickel ions;

in process stage (b), post-rinsing is performed with an aqueous solution containing 0.001 to 10 g/l of copper ions and having a pH value in the range of from 3.4 to 6;

and in process stage (c), lacquer coating is performed with a cathodically depositable electrocoating lacquer which contains no more than 0.05 wt. % of lead, relative to the dry solids content of the electrocoating lacquer.

2. A process as claimed in claim 1 wherein, in process stage (a), phosphating is performed with a phosphating solution which contains no more than 1 mg/l of copper ions.

3. A process as claimed in claim 1 wherein, in process stage (a), phosphating is performed using a phosphating solution which contains no more than 10 mg/l of nickel ions.

4. A process as claimed in claim 1 wherein, in process stage (a), phosphating is performed using a phosphating solution which additionally contains one or more of the following cations:

0.2 to 4 g/l of manganese(II)

0.2 to 2.5 g/l of magnesium(II), 0.2 to 2.5 g/l of calcium(II), 0.01 to 0.5 g/l of iron(II), 0.2 to 1.5 g/l of lithium(I), 0.02 to 0.8 g/l of tungsten(VI).

5. A process as claimed in claim 1 wherein, in process stage (b), post-rinsing is performed using an aqueous solution which contains 0.01 to 0.1 g/l of copper ions.

6. A process as claimed in claim 1 wherein, in process stage (b), post-rinsing is performed using an aqueous solution which has a temperature of 20 to 50° C.

7. A process as claimed in claim 1 wherein, in process stage (b), post-rinsing is performed using an aqueous solution which additionally contains 0.1 to 1 g/l of hexafluorotitanate and/or hexafluorozirconate ions.

8. A process as claimed in claim 1 wherein, in process stage (b), the post-rinsing solution is sprayed onto the metal surface phosphated in process stage (a).

9. A process as claimed in claim 1 wherein, in process stage (b), the post-rinsing solution is allowed to act for a period in the range from 0.5 to 10 minutes on the metal surface phosphated in process stage (a).

10. A process as claimed in claim 1 wherein there is no intermediate water rinsing between process stages (a) and (b).

11. A process according to claim 1 wherein, in process stage (c), coating is performed using a cathodically depositable electrocoating lacquer which contains no more than 0.01 wt. % of lead, relative to the dry solids content of the lacquer.

* * * * *

UNITED STATES PATENT AND TRADEMARK OFFICE

CERTIFICATE OF CORRECTION

PATENT NO. : 6,447,662 B1
DATED : September 10, 2002
INVENTOR(S) : Brouwer et al.

It is certified that error appears in the above-identified patent and that said Letters Patent is hereby corrected as shown below:

Title page,
Item [75], Inventors, delete "MO" and insert therefor -- MI --.

Signed and Sealed this

Eleventh Day of March, 2003

JAMES E. ROGAN
*Director of the United States Patent and Trademark Office*